United States Patent [19]

Dawson

[11] Patent Number: 4,564,194

[45] Date of Patent: Jan. 14, 1986

[54] EXERCISE APPARATUS

[76] Inventor: Fred Dawson, Spartan Manufacturing, 2270 Canoas Garden Ave., San Jose, Calif. 94086

[21] Appl. No.: 720,973

[22] Filed: Apr. 8, 1985

Related U.S. Application Data

[62] Division of Ser. No. 555,078, Nov. 25, 1983, abandoned.

[51] Int. Cl.[4] ..... A63B 13/00

[52] U.S. Cl. ..... 272/123; 272/117; 272/118; 272/134

[58] Field of Search ..... 272/93, 63, 62, 64, 272/103, 116, 117, 118, 122, 123, 125, 126, 134–143

[56] References Cited

U.S. PATENT DOCUMENTS

| | | | |
|---|---|---|---|
| 1,033,964 | 7/1912 | Tothill | 272/103 |
| 2,470,815 | 5/1949 | Harvey | 272/122 |
| 3,190,648 | 6/1965 | Kallenbach | 272/123 X |
| 3,235,255 | 2/1966 | Leflar | 272/125 X |
| 3,524,644 | 8/1970 | Kane | 272/62 X |
| 4,252,314 | 2/1981 | Ceppo | 272/117 |

FOREIGN PATENT DOCUMENTS

| | | | |
|---|---|---|---|
| 6600417 | 7/1967 | Netherlands | 272/62 |

*Primary Examiner*—Richard J. Apley
*Assistant Examiner*—Robert W. Bahr
*Attorney, Agent, or Firm*—Paul L. Hickman

[57] ABSTRACT

A weight lifting station including a pair of guide posts for guiding a barbell assembly in a vertical direction. The barbell assembly includes a weight bar, a sleeve telescoped over the weight bar and stop pins attached to the sleeve, where during rotation of the sleeve the stop pin can pivotally engage the guide posts through holes provided along the length of the guide post.

12 Claims, 16 Drawing Figures

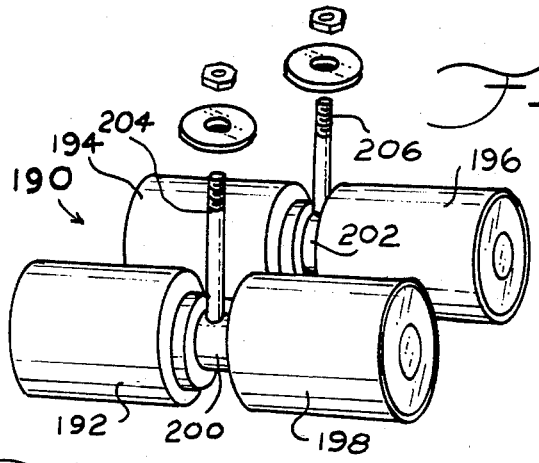
FIG. 10
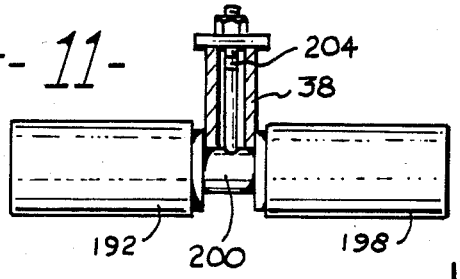
FIG. 11
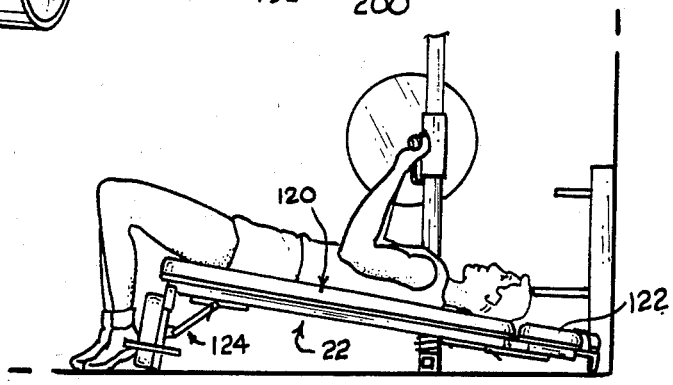
FIG. 12
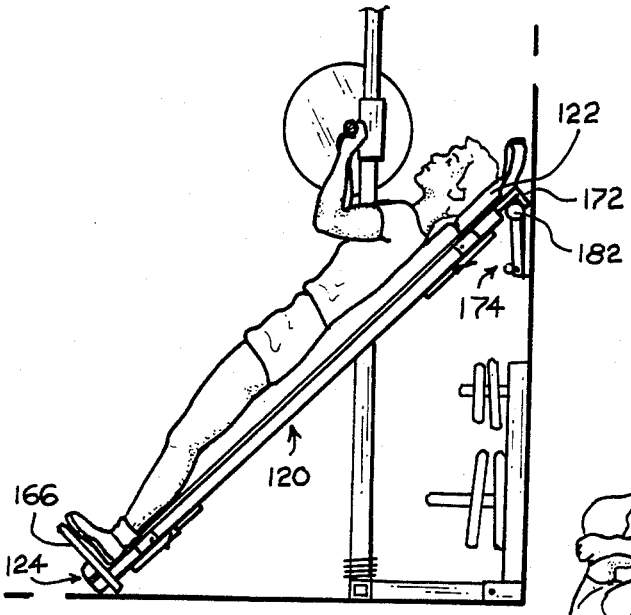
FIG. 13-a
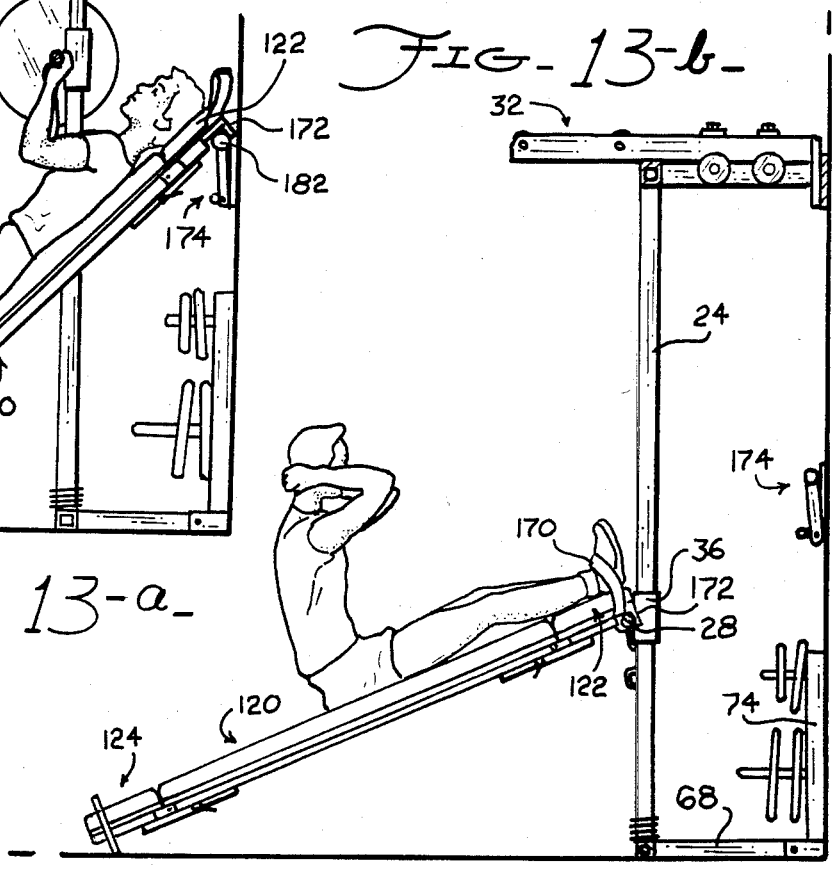
FIG. 13-b

EXERCISE APPARATUS

This application is a division of application Ser. No. 555,078, filed Nov. 25, 1983, now abandoned.

BACKGROUND OF THE INVENTION

1. Field of the Invention

This invention relates generally to exercise equipment, and more particularly to multi-purpose weight lifting equipment.

2. Description of the Prior Art

Exercise equipment generally falls within one of two main categories. A first category of exercise equipment is primarily concerned with improving the cardiovascular system by encouraging a user to make rapid, repetitive, unrestricted movements for extended periods of time. This raises the pulse rate, causes capillary expansion, and induces deep breathing, but does not usually build muscle mass.

Exercise equipment of the second category is more concerned with improving muscle tone and increasing muscle mass. This type of equipment usually requires a user to exert force against a resistance pressure provided by a weight or a spring. Of course, there is some degree of overlap between these two categories since equipment designed to increase cardiovascular fitness may also increase muscle mass, and equipment designed to increase muscle mass may also improve cardiovascular fitness. However, the primary benefit of the equipment is usually fairly well defined by which category it falls into.

Weight training belongs to the second category of exercise equipment in that it is designed primarily to increase muscle mass and to improve muscle tone. While there are many types of weight lifting apparatus, the most common are free weight units and weight lifting stations. Free weights, which are also known as barbells, usually include a long, steel bar provided with a number of disk shaped weights, and collars for holding the weights on the bar. Free weights are often used with a weight lifting bench.

One common danger of lifting free weights is that a weight lifter might injure himself by losing control and dropping the weights. It is therefore a common safety practice for weight lifters to exercise in pairs so that one of the weight lifters can act as a "spotter" for the other weight lifter. A spotter usually stands behind the weight lifter and grabs the barbell if the weight lifter seems to be losing control of it. However, this type of arrangement can be inconvenient since it is not always possible to find a weight lifting partner.

A number of inventors have developed weight lifting stations in an attempt to overcome the aforementioned problem. For example, in U.S. Pat. No. 4,252,314 of Ceppo a weight lifting station is disclosed including two support posts, a pair of slidable collars engaged with the support posts, and a weight lifting bar coupled to the slidable collars. The support posts and collars guide the weight lifting bar for reciprocal vertical movement and thus prevent a weight lifter from dropping the weights back over his head or onto his body. However, Ceppo's device does not prevent the weights from falling straight down on the weight lifter.

In U.S. Pat. No. 2,470,815 of Harvey a weight lifting station is disclosed including a pair of guide posts, a weight lifting bar, and a pair of clamping members attaching the weight lifting bar to the guide posts. By rotating the weight lifting bar, screws within the clamping portion are urged against the guide posts to provide a friction-type brake. Thus, by rotating the weight lifting bar, a weight lifter can prevent the weights from falling straight down upon him. Unfortunately, the friction type braking system of Harvey, is not as fail-safe as it might be, and requires a great deal of torque to be applied to the bar by the user. In fact, Harvey's device is provided with a lever 64 to increase the amount of torque that can be applied to the bar. To use the lever, however, the weight lifter would have to release the bar with one hand, increasing the danger that the weights might fall on him.

In U.S. Pat. No. 3,235,255 of Leflar, a weight lifting station is disclosed including a pair of guide posts, a weight lifting bar, and a clamping member slidably attaching bar 41 to the guide posts. The clamping member slides within the hollow tubular guide posts and includes a movable stop pin and a fixed stopped pin, both of which engage holes provided in the guide posts. While the stop pins prevent the movement of the bar more effectively than the friction brake of Harvey, they can not be controlled during use because the weight lifter has both of his hands on the weight lifting bar.

Weight lifting benches are often associated with weight lifting stations and with free weight units. Weight lifting benches typically include a long, padded central portion supported at either end by sturdy leg assemblies. Some exercise benches, such as the one described in U.S. Pat. No. 3,342,485 of Gaul allow one of the set of legs to fold under the central portion to allow the bench to incline. A problem with prior art incline benches of this type is that they are typically shorter than full body length and are thus not well adapted for certain exercises. However, if the central portion were lengthened so as to be more useful in their inclined position, they would be too long and bulky for use as a general purpose weight lifting bench.

Weight lifting stations and weight lifting benches are often purchased separately and sometimes from different vendors. Since prior art weight stations and weight lifting benches have not been designed to be used together, the number of exercises that can be accomplished using both pieces of equipment has been limited. A problem that the prior art has not addressed is how to design an exercise apparatus which utilizes the combination of a weight lifting station and a incline bench to provide a weight lifter with a variety of exercises.

SUMMARY OF THE INVENTION

A major object of this invention is to provide a safe, economical, multi-purpose exercise device for improving muscle tone and increasing muscle mass.

Another object of this invention is to provide a weight lifting apparatus which does not require a user to have a spotting partner.

Yet another object of this invention is to provide a multi-purpose incline bench which cooperates with a weight lifting station to allow the user to accomplish a great number of exercise routines.

Briefly, the invention comprises a weight lifting station having a weight lifting bar guided by a pair of vertically oriented guide posts, and a incline bench having end units which serve as legs for a padded, central portions or which can can extend straight out from the central portion so as to convert the bench to an incline board. The weight lifting bar is provided with a pair of "L" shaped stop pins which can swivel into engagement with apertures provided in the guide posts by a rotation of a revolving sleeve which is attached to the weight lifting bar. These stop pins provide a weight lifter with a method for self-spotting.

The weight lifting station is further characterized by a base attached to the guide posts, an upper bracing portion attached to the top of the guide posts, an assembly permitting pull-down exercises, inversion posts allowing inversion exercises, and an ajustable incline board support attached to a wall surface behind the station to allow the incline bench to be used for a variety of specialized exercises.

The incline bench includes an elongated central portion, and a pair of end units hinged to opposing longitudinal ends of the central portion. Brace mechanisms are attached between the central portion and the end units such that the end units can pivot between a position where they are substantially parallel projections of the central portion, and positions where they are substantially perpendicular to the central portion. When the end portions are perpendicular to the central portions the incline bench can be used as a standard weight lifting bench, and when the end units are extended the incline bench can be used as a full length incline board. When one end portion is extended and one end portion is perpendicular, the bench can be used as a decline bench. One of the end units is provided with a foot loop and a bracket for engaging the incline board support, and the other end unit is provided with a pair of foot plates.

The weight lifting station and the incline bench cooperate to permit a user to accomplish a number of unique exercises. For example, a user can, with the present exercise apparatus, perform inverted, inclined bench presses to strengthen muscles that were heretobefore difficult to exercise.

An advantage of this invention is that weight lifting station can be safely used by a weight lifter without the requirement of a "spotting" partner.

Another advantage of this invention is that the incline bench serves the triple duties of a sturdy weight lifting bench, a full length incline board, and a decline bench.

Yet another advantage of this invention is that the combination of the weight lifting station and the incline bench allows a user to perform exercise routines that were previously difficult or impossible to perform.

These and other objects and advantages of the present invention will no doubt become apparent upon a reading of the following descriptions and a study of the several figures of the drawing.

BRIEF DESCRIPTION OF THE DRAWING

FIG. 10 is an exploded view of the inversion assembly of the present invention which attaches to the weight lifting assembly.

FIG. 11 is a view taken along line 11—11 of FIG. 14 showing the inversion assembly attached to the weight lifting station's upper support beam assembly.

FIGS. 12–15 illustrate a few of the ways in which the present invention can be used.

DETAILED DESCRIPTION OF THE PREFERRED EMBODIMENT(S)

Referring generally to the figures, an exercise apparatus in accordance with the present invention includes a weight lifting station 20, and an incline bench 22. Some of the exercises that can be accomplished with with the combined exercise apparatus are shown in FIGS. 12–15.

The Weight Lifting Station

Figure 1:
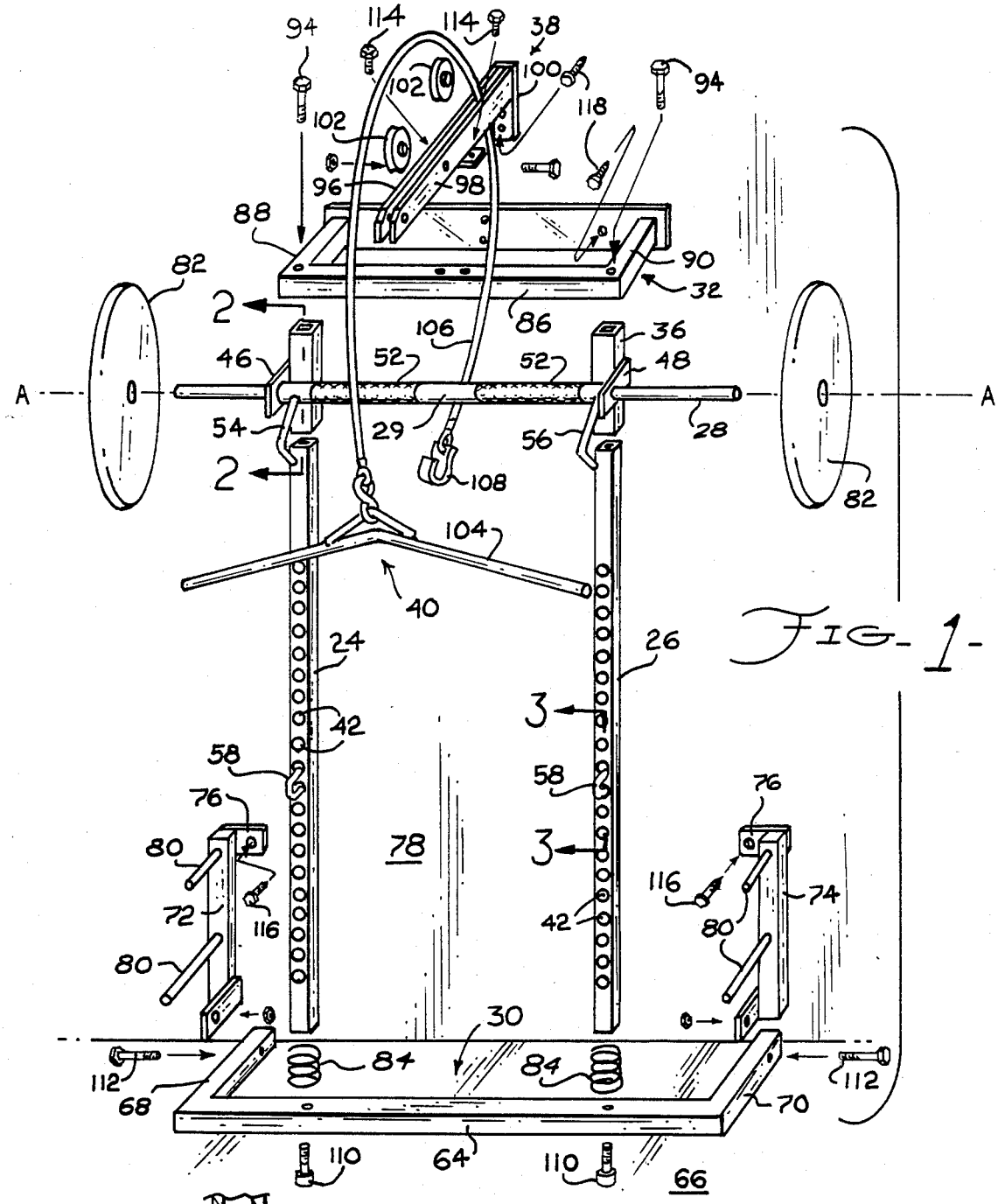
FIG. 1 is a is an exploded view of the weight lifting station of the present invention.

Referring more particularly to FIG. 1, the weight lifting station 20 includes a pair of vertically oriented guide posts 24 and 26, a horizontally oriented weight lifting bar 28, a base assembly 30, and an upper brace assembly 32. A pair of sliders 34 and 36 are telescoped over guide posts 24 and 26, respectively. A support beam assembly 38 is attached to brace assembly 32, and pull-bar assembly 40 is engagable with support beam assembly 38 and a sleeve 29 around bar 28.

Figure 2:
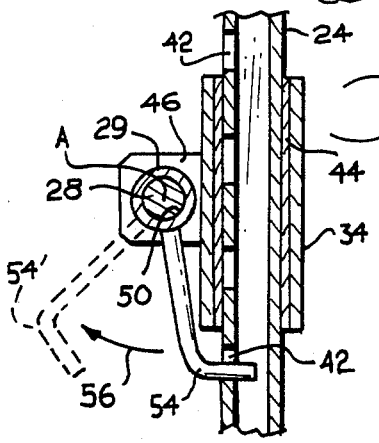
FIG. 2 is a cross-sectional view taken along line 2—2 of FIG. 1 illustrating a slider and a movable stop pin engaging a vertical guide post.

With additional reference to FIG. 2, guide posts 24 and 26 are preferably square, tubular members provided with a plurality of vertically spaced holes 42. The sliders 34 and 36 are provided with slide bearings 44 to reduce the friction between the sliders and the guide posts. Sliders 34 and 36 are provided with brackets 46 and 48, respectively, having bore holes 50 receptive to weight lifting bar 28. The weight lifting bar 28 is welded to brackets 46 and 48 and, thus, weight lifting bar 28 is horizontally supported for vertical movement along the guide posts 24 and 26.

A sleeve 29 is loosely telescoped over bar 28 between brackets 46 and 48. The sleeve 29, which is free to rotate around bar 28, is preferably constructed from a tubular section of stainless steel, and may be provided with knurling at hand hold positions 52. Sleeve 29 is also provided with a pair of stop pins 54 and 56 which are associated with guide posts 24 and 26, respectively. As noted in FIG. 2, stop pins 54 and 56 are substantially "L" shaped and have one leg attached to sleeve 29 and have another leg engagable with apertures 42 of the guide posts 24 and 26. By griping the sleeve 29 and rotating it partially around an axis "A", a user can cause stop pins 54 and 56 to engage and disengage from apertures 42. This pivotal motion is illustrated in FIG. 2 where stop member 54 can move to a new position 54' along the path suggested by arrow 56.

Figure 3:
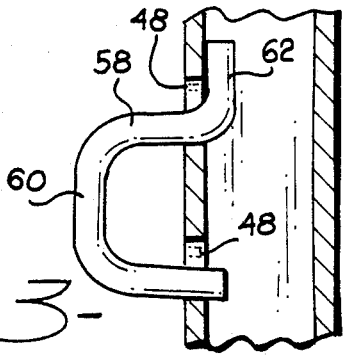
FIG. 3 is a cross-sectional view taken along line 3—3 of FIG. 2 illustrating a fixed stop pin engaged with a vertical guide post.

Referring now FIG. 3, a fixed stop member 58 may also be provided to engage a pair of apertures 48 on lower portions of guide posts 24 and 26. As seen in the illustration, the fixed stop members have a generally "C" shaped portion 60 and an upwardly bent portion 62. Fixed stop members are provided to prevent weight lifting bar 28 from accidentally crashing down on the weight lifter if he does not have enough time to engage stop pins 54 and 56 with the apertures of the guide post.

Referring again to FIG. 1, base assembly 30 includes a "C" shaped main base portion 64 which is in contact with a floor surface 66. Attached to the leg portions 68 and 70 of main base 64 are stabilizing assemblies 72 and 74. The stabilizing assemblies are provided with flanges 76 adapted to be attached to a wall surface 78. Stabilizing assemblies 72 and 74 are further provided with weight supporting rods 80 for supporting a plurality of disk shaped exercise weights such as those shown at 82. When a number of exercise weights 82 are engaged with rods 80 of the stabilizing assemblies, base assembly 30 is weighted down to improve the stability of the weight lifting station 20. Furthermore, stabilizing assemblies 72 provide a convenient place to store exercise weights 82 that are not currently being used. A pair of springs 84 can be disposed around the lower portions of guide posts 24 and 26 prevent sliders 34 and 36 from contacting the base assembly 30.

Base assembly 32 includes a "C" shaped main brace portion 86 provided wih rearwardly extending leg portions 88 and 90. A wall mounting plate is attached to leg portions 88 and 90 and to wall surface 78. The main brace assembly is attached to the top of guide posts 34 and 36 by bolts 94.

Support beam assembly 38 includes a pair of side members 96 and 98, a wall mounting plate 100, and a pair of pulleys 102 attached between side members 96 and 98. Support beam assembly 38 is attached to brace assembly 32 with suitable flanges, nuts, and bolts.

Pull bar assembly 40 includes a pull-bar 104, an elongated, flexible cable 106, and a hook 108. When cable 106 is trained over pulleys 102 of the support beam assembly 38, and hook 108 is engaged with weight bar 28, pull-bar 104 can be used for various pull-down type exercises.

To install the weight lifting station 20 of the present invention the guide posts 24 and 26 are attached to base assembly 30 with fasteners 110, and stabilizing assemblies 72 and 74 are attached to legs 68 and 70, respectively, with bolts 112. Springs 84 are placed around the bases of guide posts 24 and 26, and slider assemblies 34 and 36 are assembled with weight lifting bar 28 as shown. The sliders 34 and 36 are then engaged with guide posts 24 and 26, respectively, and upper brace assembly 32 is attached to the upper portions of guide posts 24 and 26 with bolts 94. The support beam assembly 38 is attached to brace assembly 32 with nuts and bolts 114. Stabilizing assemblies 72 and 74 are then attached to wall surface 78 with screws 116 and upper brace assembly 32 is similarly attached to wall surface 78 by a number of screws 118. Weights 82 can be placed on the ends of weight lifting bar 28 or on posts 80 of the stabilizing assembly 72 and 74. Fixed stop members 58 are placed appropriately, and stop pins 54 and 56 are engaged with apertures 42 of guide posts 24 and 26.

The Incline Bench

Referring now to FIGS. 6–9, the incline bench 22 includes a central portion 120, and a pair of end units 122 and 124 hinged to opposing ends of the central portion 120. Central portion 120 includes an elongated board 126, and a padded upper portion 128. Padded portion 128 can be covered with a strong, flexible plastic material such as naughahyde. A support spine 130 is attached to the bottom of board 126 with a flange 132.

End units 122 and 124 are provided with substantially rectangular board sections 138 and 140, respectively and support spines 142 and 144, respectively. Extension pieces 146 and 148 allow support spines 142 and 144 of the end units to be attached to support spine 130 of the central portion with pivot bolts 150. As will be explained subsequently, pivot bolts 150 allow end units 122 and 124 to pivot between a position substantially at right angles to central portion 120 and a position substantially parallel to the central portion 120.

A pair of adjustable brace mechanisms 152 and 154 couple the central portion 120 to the end units 122 and 124. Referring more particularly to the portion of FIG. 6 encircled by broken line 7, adjustable brace 54 includes a "U" shaped rail 156 attached to support spine 130, a connecting link 158, a pivot block 160 attaching one end of link 158 to spine 144 of end unit 124, and a clamping assembly 162 attaching the other end of link 158 to "U" shaped rail 156. When loosened, the upper end of link 156 is free to slide along the rail, allowing end unit 124 to pivot as suggested in FIG. 8. When tightened, clamp 162 firmly affixes the upper end of link 158 to rail 156 to rigidly hold the end unit 124 in position.

Figure 7:
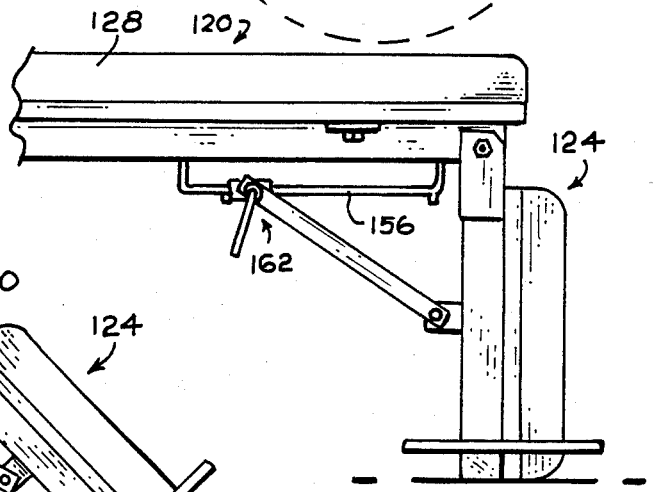
FIG. 7 is a fractional, enlarged view of portion of FIG. 6 that is encircled with broken line 7 illustrating the mechanism that controls the position of the leg portion.
Figure 8:
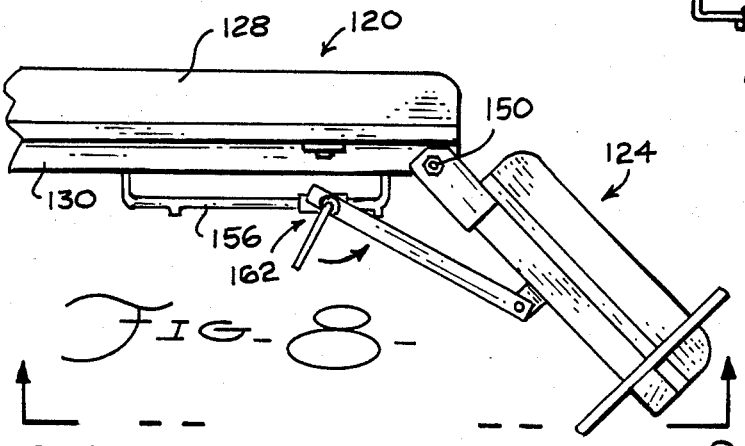
FIG. 8 is the same view as FIG. 7 with the leg portion of the incline bench moving towards an extended position where the bench can be used as an incline board.
Figure 9:
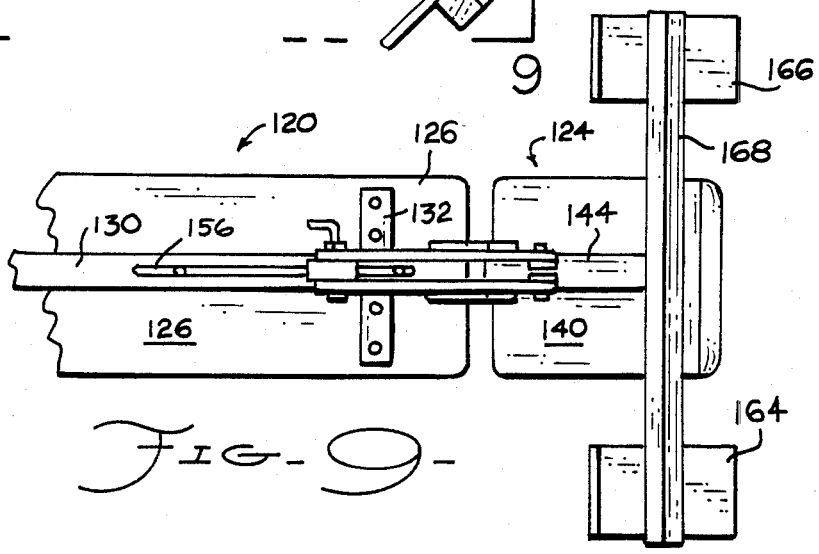
FIG. 9 is a bottom plan view of the incline bench taken along line 9—9 of FIG. 8 further illustrating the mechanism that controls the position of the leg portion.

Referring now to FIGS. 7, 8, and 9, the incline board of the present invention can be used at either as a conventional weight lifting bench, a decline bench, or as an incline board. In FIG. 7, end unit 124 is substantially perpendicular to central portion 120 and thus serves as a leg to support the central portion. As clamp 162 is loosened, end unit 124 can pivot as suggested in FIG. 8 towards a position where it is substantially a straight extension of central portion 120. End unit 124 can be retained in this position by re-tightening clamp 162.

When the end units are extended parallel to central portion 120 the effective length of the incline bench or incline board is substantially increased. The design of the present invention allows a conveniently compact weight lifting bench to be easily and quickly converted into a full length incline board.

Figure 6:
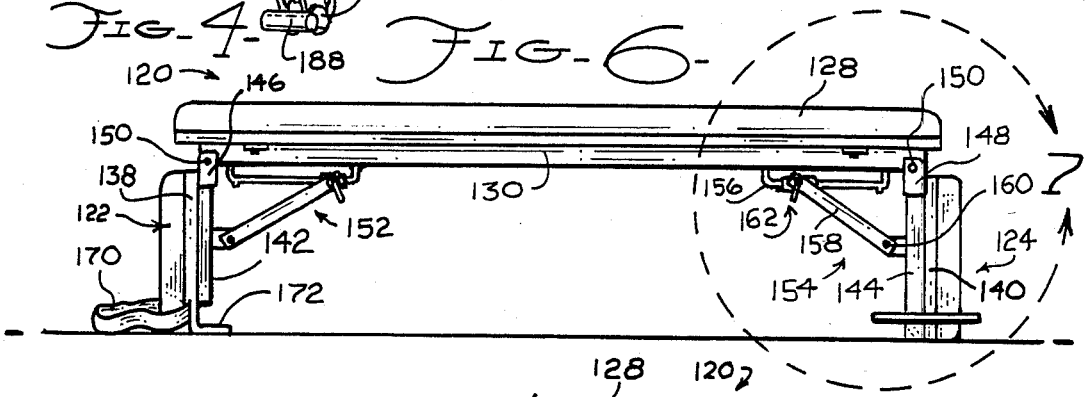
FIG. 6 is a side elevational view of the incline bench of the present invention in its horizontal configuration.

Referring now to FIGS. 6 and 9, end unit 124 is provided with a pair of foot plates 164 and 166 attached to support spine 144 by a laterally extending bar 168. End unit 122 is provided with a foot loop 170 and an engagement flange 172 for purposes to be discussed subsequently.

Other Accessories

Figure 4:
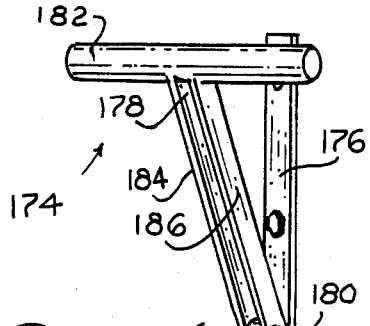
FIG. 4 is a perspective view of the adjustable bench support which enables a user to perform various incline exercises with the weight lifting station.
Figure 5:
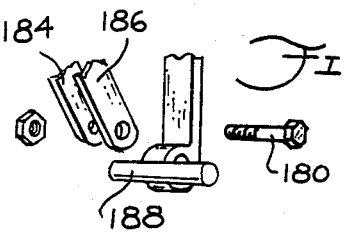
FIG. 5 is an exploded view of the lower portion of the bench support shown in FIG. 4 illustrating the pivot connection and the safety stop member.

With reference to FIGS. 4 and 5, an incline board support assembly 174 includes a wall mounting bracket 176 and a "T" bar 178 attached to bracket 176 by a pivot 180. "T" bar 178 includes a short rod 182 connected to a bifurcated stem including stem portions 184 and 186. A cylindrical stop 188 is provided to limit the degree of rotation of the "T" bar 178 relative to bracket 176.

Incline support assembly 174 is preferably attached to a section of wall 78 located between the base assembly 30 and the upper base assembly 32. Flange 172 of end unit 122 of the inclined bench 22 can be engaged with bar 182 of the incline support assembly to support the incline bench at a desired angle. The angle may be changed by loosening pivot bolt 180, rotating "T" bar assembly 178 to a desired position, and then re-tightening pivot 180. In this preferred embodiment, incline support assembly 174 is coupled to weight lifting station 20 by wall surface 78. In a free standing version of the present invention, incline support assembly 174 could be attached to weight lifting station 20 by suitable support posts and braces.

Referring now to FIGS. 10 and 11, an inversion assembly 190 including four padded inversion posts 192, 194, 196, and 198 attached to central axles 200 and 202 can also be provided. As seen in FIG. 11, axles 200 and 202 can be attached to support beam assembly 38 by bolts 204 and 206. As will be discussed subsequently, conversion posts 192–198 allows a user to hang upside down from support beam assembly 38.

Operational Examples

Referring now to FIG. 12, incline bench 22 is shown in its semi-inclined configuration with end unit 122 extended straight out from central portion 120 and with end unit 124 angled 90° relative central portion 120. In this position a weight lifter can perform inclined bench presses as shown.

In FIG. 13*a*, both end unit 122 and end unit 124 are extended straight out from central portion 120 to convert the incline bench to an incline board. The weight lifter rests against the incline board with his feet on foot plates 164 and 166. Flange 172 is engaged with bar 182 of the incline support assembly 174.

In FIG. 13*b*, both end units 122 and 124 are once again extended straight out from central portion 120, and flange 172 is engaged with the sleeve 29 around bar 28. In this position, the bench can be inclined to a number of angles by adjusting weight bar 28 to a desired height so that the bench can be used for situps, leg exercises, etc.

Figure 14:
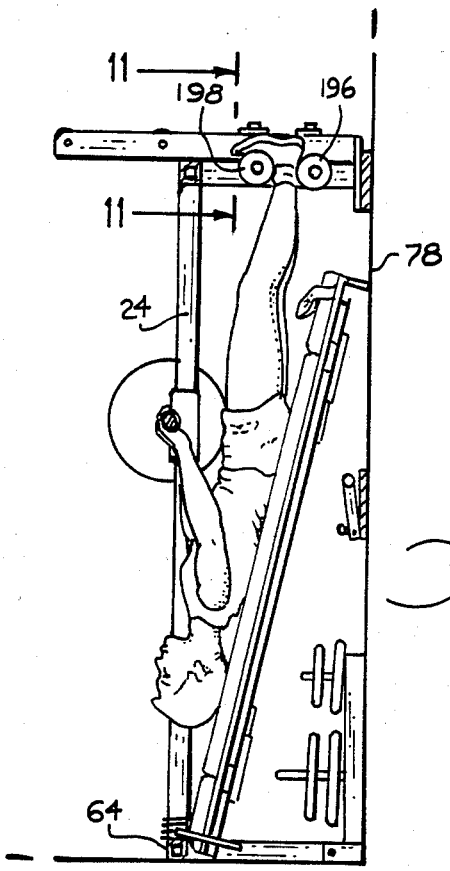

Referring to FIG. 14, the incline board can also be engaged with main base portion 64 of the weight lifting station 20. In this figure, a user has his feet engaged with padded foot posts 192–198 so as to be able to perform inversion exercises.

Figure 15:
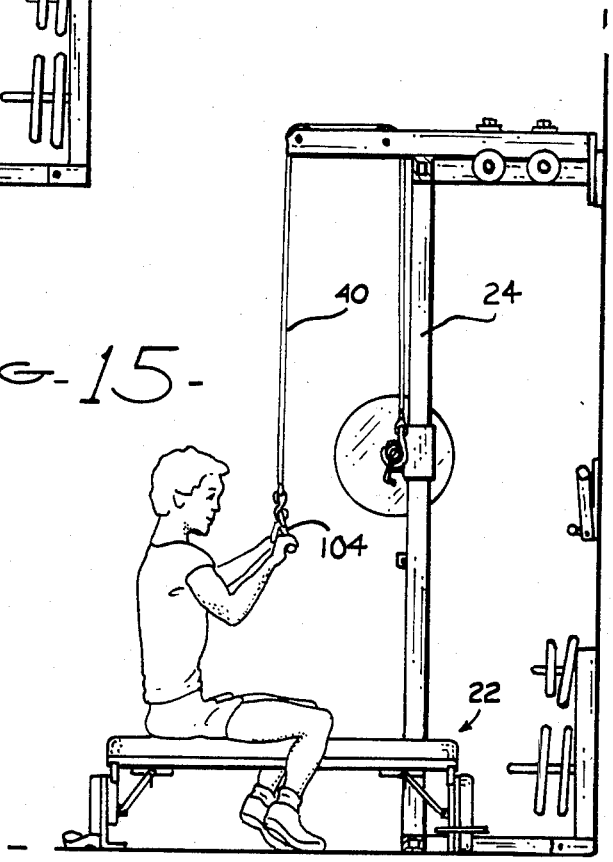

In FIG. 15, a weight lifter is using the pull bar assembly 40 to perform pull down exercises. As bar 104 is pulled down, hook and cable will cause weight lifting bar 28 to move up along the guide posts 24 and 26. Incline bench 22 is shown in this figure and its standard weight lifting bench configuration.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A weight lifting station comprising:

a pair of separated, substantially vertical guide posts;

elongated, substantially horizontal bar means adapted to receive one or more exercise weights extending between said guide posts and having an axis of rotation;

means attaching said bar means to said guide posts such that said bar means may reciprocate in a direction parallel to said guide posts and may at least partially rotate around said axis; and pivotal stop means attached to said bar means for engaging at least one of said guide posts, said stop means being operated by a rotation of said bar means.

2. A weight lifting station as recited in claim 1 further comprising base means attached to lower ends of said pair of guide posts, said base means being in contact with a floor surface; and upper brace means attached to upper ends of said pair of guide posts.

3. A weight lifting station as recited in claim 2 wherein said base means includes a main base portion, and means for attaching said main base portion an immobile surface.

4. A weight lifting station as recited in claim 3 wherein said immobile surface is vertical to said floor surface; and wherein said weight lifting station further comprises incline support means attached to said immobile surface, and an incline board having a first end engagable with said support means and a second end adapted to contact said floor surface.

5. A weight lifting station as recited in claim 4 wherein said incline support means includes a mounting bracket attached to said immobile surface, a T bar pivotally attached at its base to said mounting bracket, and means for setting the angular position of said T bar relative said mounting bracket.

6. A weight lifting station as recited in claim 2 wherein said base means includes a stabilizing assembly adapted to support at least one stabilizing weight.

7. A weight lifting station as recited in claim 2 wherein said upper brace means includes a support beam assembly provided with four inversion posts adapted to engage the feet of a user for inversion exercises.

8. A weight lifting station as recited in claim 2 wherein said upper brace means includes a support beam assembly provided with pulley means; and wherein said weight lifting station further comprises a pull-bar, and an elongated cable trained over said pulley means and attached at one end to said pull bar and at its other end to said bar means.

9. A weight lifting station as recited in claim 1 wherein said pair of vertical guide posts are each provided with a plurality of vertically spaced apertures.

10. A weight lifting station as recited in claim 9 further comprising at least one fixed stop member selectively engagable with said vertically spaced apertures.

11. A weight lifting station as recited in claim 9 wherein said pivotal stop means includes a pair of L shaped stop pins associated, one each, with said pair of support posts, said stop pins having one leg attached to a rotatable sleeve of said bar means that is telescoped over a non-rotatable bar of said bar means, whereby the other end of said "L" shaped stop pins can be caused to engage or disengage said apertures by rotating said sleeve.

12. A weight lifting station as recited in claim 2 wherein said sliders are provided with slide bearings; and wherein said weight lifting station further comprises springs disposed around the lower ends of said support posts to prevent said sliders from contacting said base means.

* * * * *